US005092123A

United States Patent [19]

Nada et al.

[11] Patent Number: 5,092,123

[45] Date of Patent: Mar. 3, 1992

[54] AIR-FUEL RATIO FEEDBACK CONTROL SYSTEM HAVING AIR-FUEL RATIO SENSORS UPSTREAM AND DOWNSTREAM OF THREE-WAY CATALYST CONVERTER

[75] Inventors: Mitsuhiro Nada, Susono; Hiroshi Sawada, Gotenba, both of Japan

[73] Assignee: Toyota Jidosha Kabushiki Kaisha, Toyota, Japan

[21] Appl. No.: 718,021

[22] Filed: Jun. 20, 1991

[30] Foreign Application Priority Data

Jul. 2, 1990 [JP] Japan ..... 2-172649

[51] Int. Cl.[5] ..... F02D 41/14

[52] U.S. Cl. ..... 60/274; 60/276; 60/285; 123/489

[58] Field of Search ..... 60/274, 276, 277, 284; 123/440, 489, 589

[56] References Cited

U.S. PATENT DOCUMENTS

| | | | |
|---|---|---|---|
| 4,905,469 | 3/1990 | Matsuoka | 60/274 |
| 5,052,177 | 10/1991 | Nada | 60/274 |
| 5,070,692 | 12/1991 | Nada | 60/274 |
| 5,070,693 | 12/1991 | Nada | 60/274 |

FOREIGN PATENT DOCUMENTS

| | | | |
|---|---|---|---|
| 58-48745 | 3/1983 | Japan . | |
| 64-53042 | 3/1989 | Japan . | |
| 0230935 | 9/1990 | Japan | 123/489 |

*Primary Examiner*—Ira S. Lazarus
*Assistant Examiner*—L. Heyman
*Attorney, Agent, or Firm*—Kenyon & Kenyon

[57] ABSTRACT

In an air-fuel ratio feedback control system including air-fuel ratio sensors upstream and downstream of a three-way catalyst converter, the cold-condition compensating term is calculated in accordance with the upstream air-fuel ratio sensor disposed upstream of the catalyst converter, and the $O_2$ storage term is calculated in accordance with the downstream air-fuel ratio sensor disposed downstream thereof.

24 Claims, 12 Drawing Sheets

AIR-FUEL RATIO FEEDBACK CONTROL SYSTEM HAVING AIR-FUEL RATIO SENSORS UPSTREAM AND DOWNSTREAM OF THREE-WAY CATALYST CONVERTER

BACKGROUND OF THE INVENTION

1. Field of the Invention

The present invention relates to an air-fuel ratio feedback control system in an internal combustion engine having air-fuel ratio sensors upstream and downstream of a three-way reducing and oxidizing catalyst converter in an exhaust gas passage.

2. Description of the Related Art

Among known air-fuel ratio feedback control systems using air-fuel ratio sensors ($O_2$ sensors), there exists a single $O_2$ sensor system, i.e., having only one $O_2$ sensor. Note, in this system the $O_2$ sensor is disposed either upstream or downstream of the catalyst converter.

In a single $O_2$ sensor system having an $O_2$ sensor upstream of the catalyst converter, the $O_2$ sensor is disposed in the exhaust gas passage near to a combustion chamber, i.e., near the concentration portion of an exhaust manifold. In this system, however, the output characteristics of the $O_2$ sensor are directly affected by a non-uniformity or non-equilibrium state of the exhaust gas. For example, when the air-fuel ratio actually indicates a rich state, but oxygen is still present, the output characteristics of the $O_2$ sensor fluctuate. Also, in an internal combustion engine having a plurality of cylinders, the output characteristics of the $O_2$ sensor are also directly affected by differences in individual cylinders, and accordingly, it is impossible to detect the mean air-fuel ratio for the entire engine, and thus the accuracy of the control of the air-fuel ratio is low.

On the other hand, in a single $O_2$ sensor system having an $O_2$ sensor downstream of the catalyst converter, the non-uniformity or non-equilibrium state of the detected exhaust gas has little or no effect, and thus the mean air-fuel ratio for the engine can be detected. In this system, however, due to the capacity of the catalyst converter, the response characteristics of the $O_2$ sensor are lowered, and as a result, the efficiency of the catalyst converter cannot be properly exhibited, and thus the HC, CO and $NO_x$ emissions are increased.

To solve the above problems, the following method, for example, is known. Namely, the actual air-fuel ratio is adjusted by a self-oscillating term, and a mean value thereof, i.e., a coarse-adjusting term, is controlled in accordance with the output of the $O_2$ sensor disposed downstream of the catalyst converter.

Nevertheless, this method cannot eliminate the increase of HC, CO and $NO_x$ emissions occurring when the actual air-fuel ratio deviates from the stoichiometric air-fuel ratio, because the integral speed for the coarse-adjusting term is set at a small value, and it takes a long time to correct the air-fuel ratio so that the efficiency of the catalyst converter is properly exhibited.

To solve the above problem, the present inventor has already suggested a method of using a proportional $O_2$ storage term and an integral $O_2$ storage term, to forcibly shift the coarse-adjusting term when the output of the $O_2$ sensor disposed downstream of the catalyst converter is outside a pre-determined region, or when the actual air-fuel ratio has become rich after the completion of the warming-up of the catalyst converter.

The above method, however, cannot eliminate the increase of HC, CO and $NO_x$ emissions, when the catalyst converter is cold because the functioning of the $O_2$ sensor is delayed, even if it is equipped with a heater, and the start of the air-fuel ratio feedback control is also delayed because the $O_2$ sensor is located at a position where the exhaust gas temperature is low.

SUMMARY OF THE INVENTION

Therefore, an object of the present invention is to provide an air-fuel ratio control system able to prevent an increase of HC, CO and $NO_x$ emissions when the catalyst converter is cold.

According to this invention, in an air-fuel ratio feedback control system including air-fuel ratio sensors upstream and downstream of a three-way catalyst converter, a coarse-adjusting term AFc is calculated integrally in accordance with the output of a second air-fuel ratio sensor disposed downstream of the catalyst converter (downstream $O_2$ sensor), an $O_2$ storage term AFccro is also calculated integrally and proportionally in accordance with the output of the downstream $O_2$ sensor, and a cold-condition compensating term AFfr is calculated proportionally and integrally in accordance with the output of the air-fuel ratio sensor disposed upstream of the catalyst converter (upstream $O_2$ sensor) when the downstream air-fuel sensor is not activated.

Namely, the air-fuel ratio feedback control is begun in accordance with the output of the upstream $O_2$ sensor when it is activated, even when the catalyst converter is cold, and thus an increase of HC, CO and $NO_x$ emissions is eliminated. Thereafter, when the downstream $O_2$ sensor is activated, the air-fuel ratio feedback control is determined in accordance with the downstream $O_2$ sensor.

BRIEF DESCRIPTION OF THE DRAWINGS

The present invention will be more clearly understood from the description as set forth below with reference to the accompanying drawings.

DESCRIPTION OF THE PREFERRED EMBODIMENTS

Figure 1:
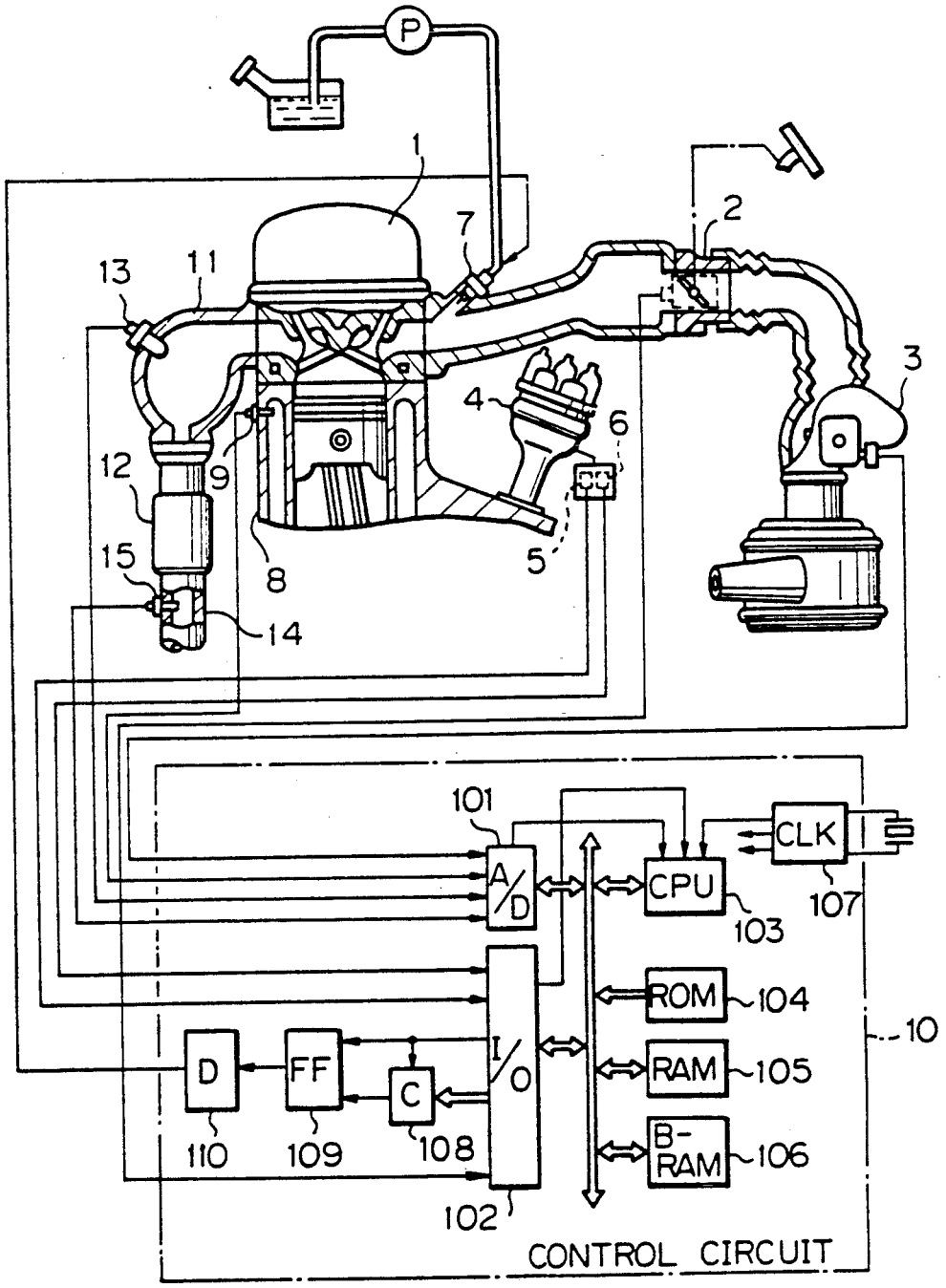
FIG. 1 is a schematic view of an internal combustion engine according to the present invention.

In FIG. 1, which illustrates an internal combustion engine according to the present invention, reference numeral 1 designates a four-cycle spark ignition engine disposed in an automotive vehicle, wherein an air-intake passage 2 of the engine 1 is provided with a potentiometer-type airflow meter 3 for detecting an amount of air drawn into the engine 1, and generating an analog voltage signal proportional to the amount of air flowing therethrough. The signal from the air-flow meter 3 is transmitted to a multiplexer-incorporating analog-to-digital (A/D) converter 101 of the control circuit 10.

Crank angle sensors 5 and 6, for detecting the angle of the crank-shaft (not shown) of the engine 1, are disposed at a distributor 4.

In this case, the crank angle sensor 5 generates a pulse signal at every 720° crank angle (CA) and the crank-angle sensor 6 generates a pulse signal at every 30° CA. The pulse signals from the crank angle sensors 5 and 6 are supplied to an input/output (I/O) interface 102 of the control circuit 10. Further, the pulse signal of the crank angle sensor 6 is then supplied to an interruption terminal of a central processing unit (CPU) 103.

Also provided in the air-intake passage 2 is a fuel injection valve 7 for supplying pressurized fuel from the fuel system to the air-intake port of the cylinder of the engine 1. Note, other fuel injection valves are provided for other cylinders, but these are not shown in FIG. 1.

A coolant temperature sensor 9 for detecting the temperature of the coolant is disposed in a cylinder block 8 of the engine 1. The coolant temperature sensor 9 generates an analog voltage signal in response to the temperature THW of the coolant, and transmits this signal to the A/D converter 101 of the control circuit 10.

A three-way reducing and oxidizing catalyst converter 12, which simultaneously removes three pollutants, CO, HC and $NO_x$ from the exhaust gas, is provided in an exhaust system on the downstream-side of an exhaust manifold 11.

A second $O_2$ sensor 15 (downstream $O_2$ sensor) for detecting the concentration of oxygen composition in the exhaust gas is provided in an exhaust pipe 14 downstream of the catalyst converter 12. This downstream $O_2$ sensor 15 generates an output voltage signal and transmits the signal to an A/D converter 101 of the control circuit 10.

A first $O_2$ sensor 13 (upstream $O_2$ sensor) is disposed in an exhaust manifold 11 of the engine 1, for the same purpose as that of the downstream $O_2$ sensor 15. The upstream $O_2$ sensor 13 also generates and transmits an output signal.

Reference 16 designates a throttle valve, and 17 designates a throttle sensor which incorporates and idle switch for detecting a time at which the throttle valve 16 is fully closed. The output LL of the idle switch is supplied to the I/O interface 102 of the control circuit.

The control circuit 10, which may be constructed by a microcomputer, further comprises a central processing unit (CPU) 103, a read-only-memory (ROM) 104 for storing a main routine and interrupt routines such as a fuel injection routine, an ignition timing routine and constants, etc., a random-access-memory 105 (RAM) for storing temporary data, a backup RAM 106, a clock generator 107 for generating various clock signals, a down counter 108, a flip-flop 109, and a drive circuit 110 and the like.

Note, that a battery (not shown) is connected directly to the backup RAM 106, and therefore, the content thereof is not erased even when the ignitions switch (not shown) is turned off.

The down counter 108, flip-flop 109, and drive circuit 110 are used for controlling the fuel injection valve 7. Namely, when a fuel injection amount TAU is calculated in a TAU routine, as explained later, the amount TAU is preset in the down counter 108, and simultaneously, the flip-flop 109 is set, and as a result, the drive circuit 110 initiates the activation of the fuel injection valve 7. On the other hand, the down counter 108 counts up the clock signal from the clock generator 107, and finally a logic "1" signal is generated from the borrow-out terminal of the down counter 108, to reset the flip-flop 109, so that the drive circuit 110 stops the activation of the fuel injection valve 7, whereby an amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q from the airflow meter 3 and the coolant temperature data THW from the coolant sensor 9 are fetched by an A/D conversion routine(s) executed at predetermined intervals, and then stored in the RAM 105; i.e., the data Q and THW in RAM 105 are renewed at predetermined intervals.

Figure 2:
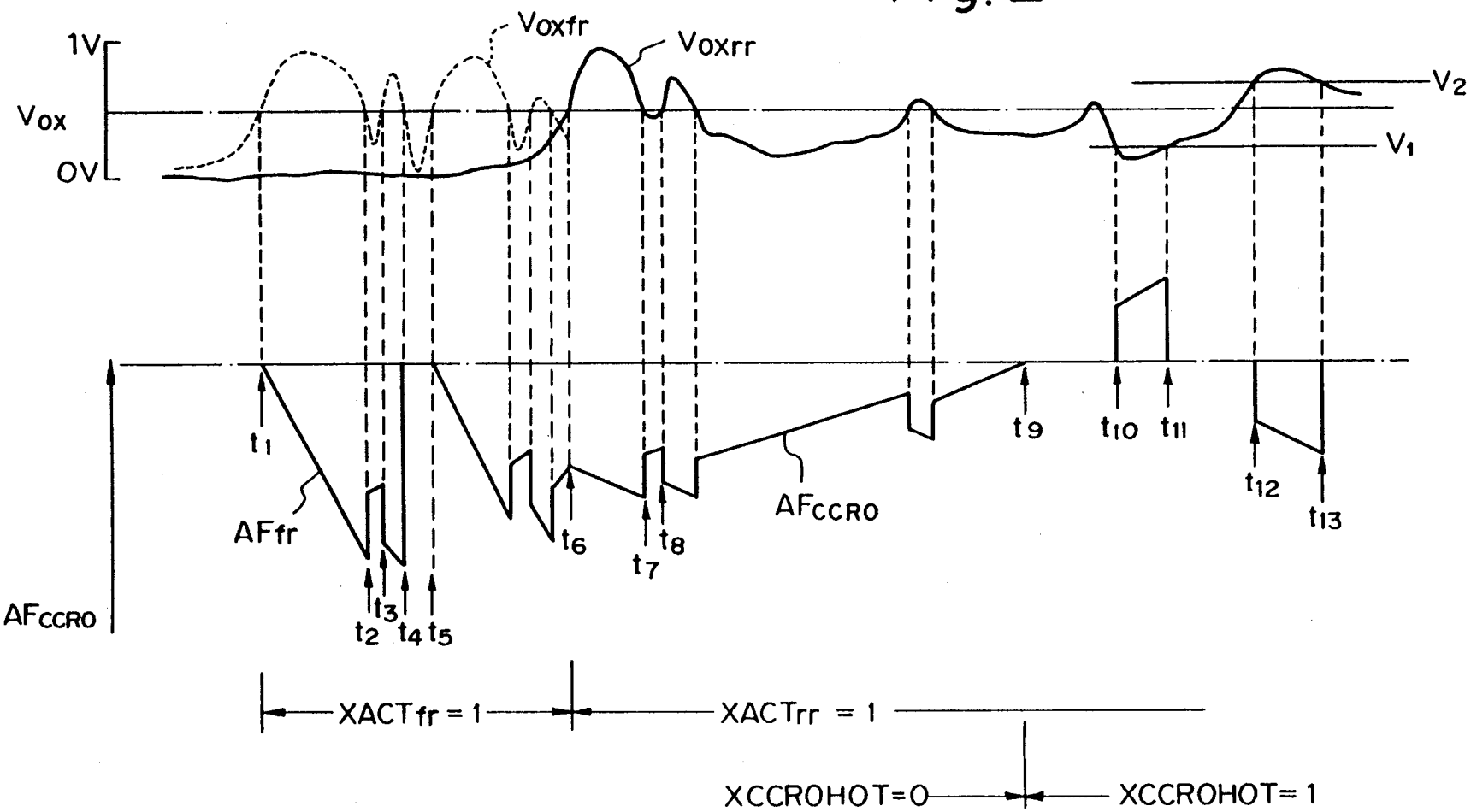
FIG. 2 is a timing diagram for explaining the control scheme of the present invention.

FIG. 2 is a timing diagram for explaining the control operation of the present invention, wherein the abscissa shows time and the ordinate shows the outputs of the two $O_2$ sensors, the value of the $O_2$ storage term, and the value of the cold-condition compensating term. Note, the output of the downstream $O_2$ sensor 15, Voxrr, is shown by a solid line, and that of the upstream $O_2$ sensor 13, Voxfr, is shown by a dotted line. Each control routine will be further explained with reference to FIG. 3.

Figure 3:
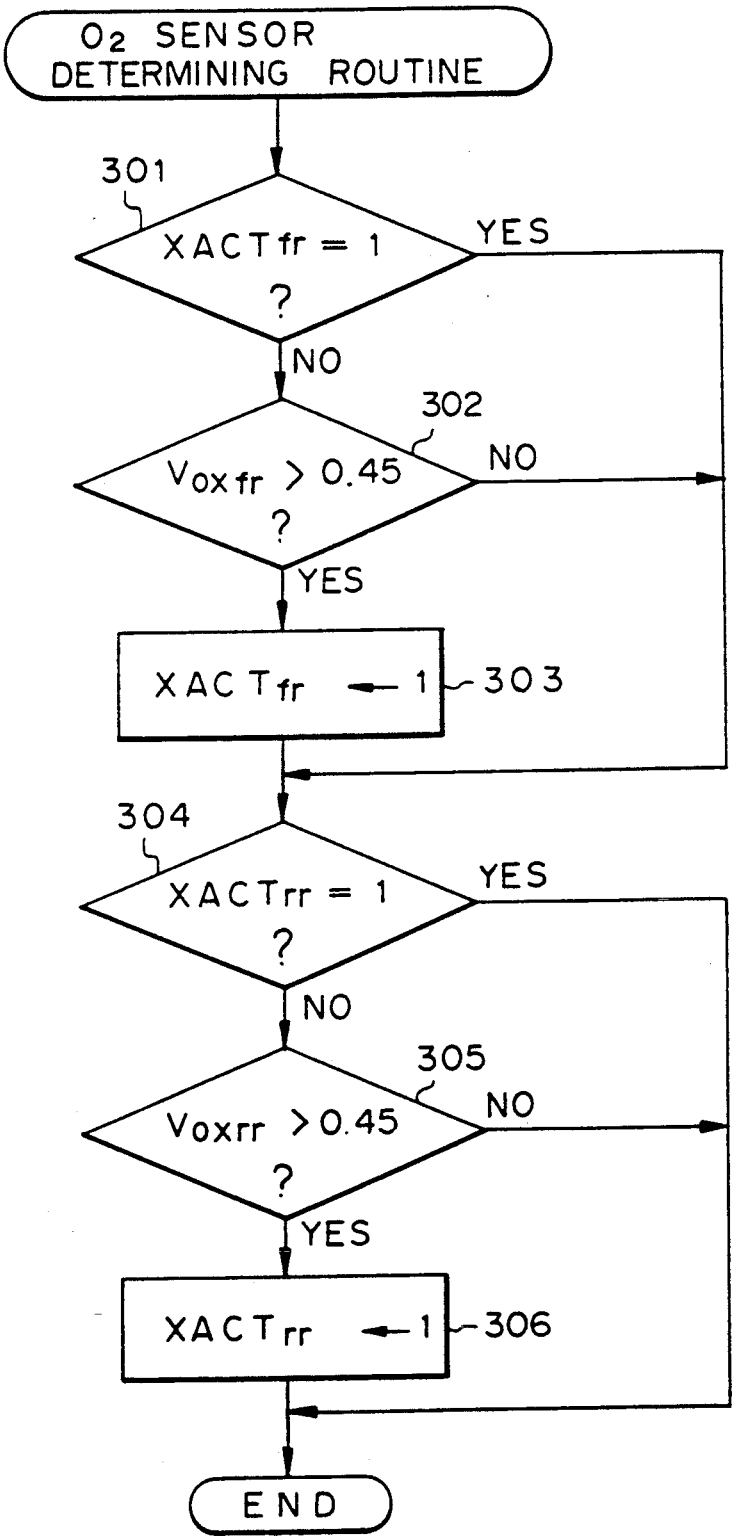
FIGS. 3, 4, 5, 6, 8, 9, 10, 11 and 12 are flow charts showing the operation of the control circuit of FIG. 1.

FIG. 3 is a routine for determining whether or not the downstream $O_2$ sensor 15 and the upstream $O_2$ sensor 13 are activated, and is executed at predetermined intervals such as 4 ms. Note, the flags XACTfr and XACTrr, which denote that the upstream and the downstream $O_2$ sensors 15 and 13 have been activated respectively, are reset to "0" by an initialising routine (not shown).

At step 301, it is determined whether or not the flag XACTfr is "1". If the flag XACTfr is "0", the control proceeds to step 302, and at step 302 the voltage Voxfr, i.e., the output of the upstream $O_2$ sensor 13, is compared with the reference voltage Vr e.g., 0.45 V, to determine whether or not the upstream $O_2$ sensor 13 has been activated.

If Voxfr is larger than Vr, which means that the upstream $O_2$ sensor 13 has been activated, the control proceeds to step 303, which sets "1" in the flag XACTfr.

At step 302, if Voxfr is smaller than Vr, which means that the upstream $O_2$ sensor has not been activated, the control proceeds to step 304.

For example, as shown in FIG. 2, the upstream $O_2$ sensor 13 has been activated at the timing $t_1$.

Note, once the flag XACTfr is set to "1", the control proceeds thereafter directly to step 304.

At step 304, it is determined whether or not the flag XACTrr is "1". If the flag XACTrr is "0", the control proceeds to step 305. At step 305, the voltage Voxrr, i.e., the output of the downstream $O_2$ sensor 15, is compared with the reference voltage Vr, e.g., 0.45 V, to determine whether or not the downstream $O_2$ sensor 15 has been activated.

If Voxrr is larger than Vr, which means that the downstream $O_2$ sensor 15 has been activated, the control proceeds to step 306, which sets "1" in the flag XACTrr.

At step 305, if Voxrr is smaller than Vr, which means that the downstream $O_2$ sensor has not been activated, the control is completed.

For example, as shown in FIG. 2, the downstream $O_2$ sensor 15 has been activated at the timing $t_6$.

Note, once the flag XACTrr is set to "1", thereafter this routine is completed.

Figure 4:
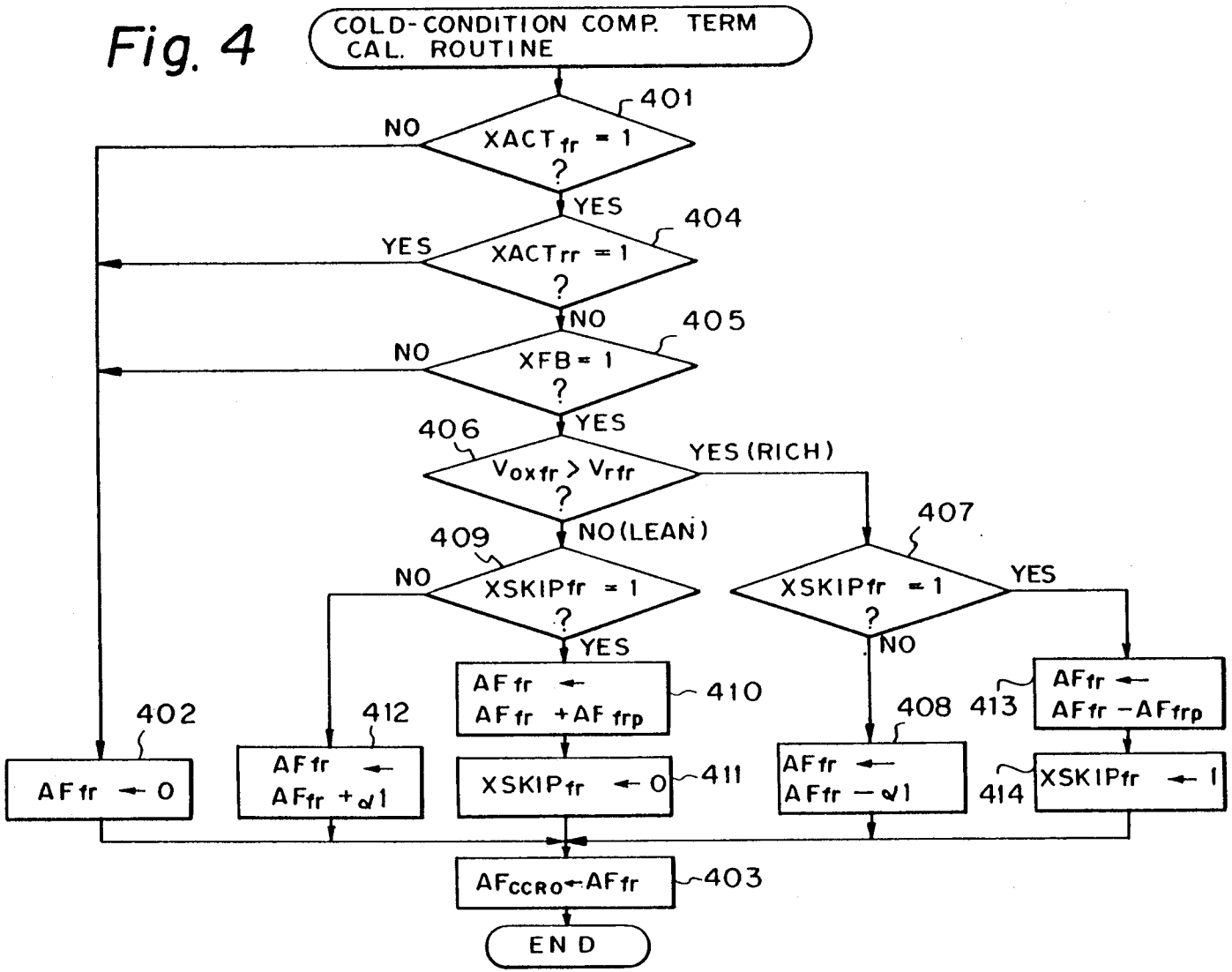

FIG. 4 is a routine for calculating a cool-condition compensating term AFfr in accordance with the output Voxfr of the upstream $O_2$ sensor 13, and is executed at predetermined intervals such as 4 ms.

At step 401, it is determined whether or not the upstream $O_2$ sensor 13 has been activated. If the upstream $O_2$ sensor 13 has not been activated, the control proceeds to step 402, which clears the cold-condition compensating term AFfr to "0", and the control then proceeds to step 403, which changes the $O_2$ storage term from AFccro to AFfr.

Once the upstream $O_2$ sensor has been activated, i.e., after $t_1$ in FIG. 2, the control proceeds to step 404 and it is determined whether or not the downstream $O_2$ sensor 15 has been activated.

Once the downstream $O_2$ sensor 15 has been activated, the control proceeds to 402.

Before the downstream $O_2$ sensor 15 is activated, i.e., before $t_6$ in FIG. 2, the control proceeds to step 405 and it is determined whether or not all of the feedback control (closed-loop control) conditions at the upstream or downstream $O_2$ sensor are satisfied.

For example, the feedback control is inhibited under the following conditions.

i) the engine is in a fuel cut-off state;

ii) the engine is in a state of waiting for a predetermined interval after a fuel cut-off condition has been released;

iii) the engine is in a fuel increase condition, to prevent an overheating of the catalyst converter;

iv) the engine is in a power increase condition.

In the above-mentioned conditions, if a flag XFB, which shows that the feedback control conditions are satisfied, is "0", the control proceeds to step 402.

In this case, the flag XFB is reset to "0", by a not-shown routine.

When the feedback control conditions are satisfied, the flag XFB is set to "1" and the control proceeds to step 406. Thereafter, the cold-condition compensating term AFfr is calculated in the following steps.

In step 406, it is determined whether or not the output voltage of the upstream $O_2$ sensor 13, Voxfr is higher than the predetermined value Vrfr corresponding to the stoichiometric state, e.g., 0.45 V.

If Voxfr is larger than Vrfr, which means that the current air-fuel ratio is rich, the control proceeds to step 407.

In step 407, it is determined whether or not an air-fuel ratio flag XSKIPfr is "1".

If XSKIPfr is "0", which means that Voxfr has remained rich since the previous execution, the control proceeds to step 408, which lowers the cold-condition compensating term AFfr by $\alpha 1$, and the control then proceeds to step 403.

Therefore, the cold-condition compensating term AFfr is integrally lowered, as shown in FIG. 2, between the times $t_1$ and $t_2$.

If the air-fuel ratio is inverted from rich to lean by this control, the control proceeds to step 409, because Voxfr is smaller than Vrfr.

At step 409, it is determined whether or not the flag XSKIPfr is "1", which means that the air-fuel ratio has been inverted from rich to lean, and the control then proceeds to step 410.

At step 410, the cold-condition compensating term AFfr is greatly increased by the predetermined value, AFfrp, and the control proceeds to step 411, at which "0" is reset in the air-fuel ratio flag XSKIPfr, and then proceeds to step 403.

If the lean condition continues thereafter, the control proceeds to step 412, which integrally increases the cold-condition compensating term AFfr by $\alpha 1$, and then proceeds to step 403.

Therefore, the cold-condition compensating term AFfr is proportionally increased at the time $t_2$, and then is integrally increased between $t_2$ and $t_3$.

If the air-fuel ratio is inverted from lean to rich by this control, the control proceeds to step 413, which greatly lowers the cold-condition compensating term AFfr. Then the control proceeds to step 414, which sets "1" in the air-fuel ratio flag XSKIPfr, the then to step 403.

If the rich condition continues thereafter, the control proceeds to step 408, which integrally lowers the cold-condition compensating term AFfr, and finally, at step 403, the cold-condition compensating term AFfr is replaced by the $O_2$ storage term, to obtain a smooth change of the control mode.

Figure 5:
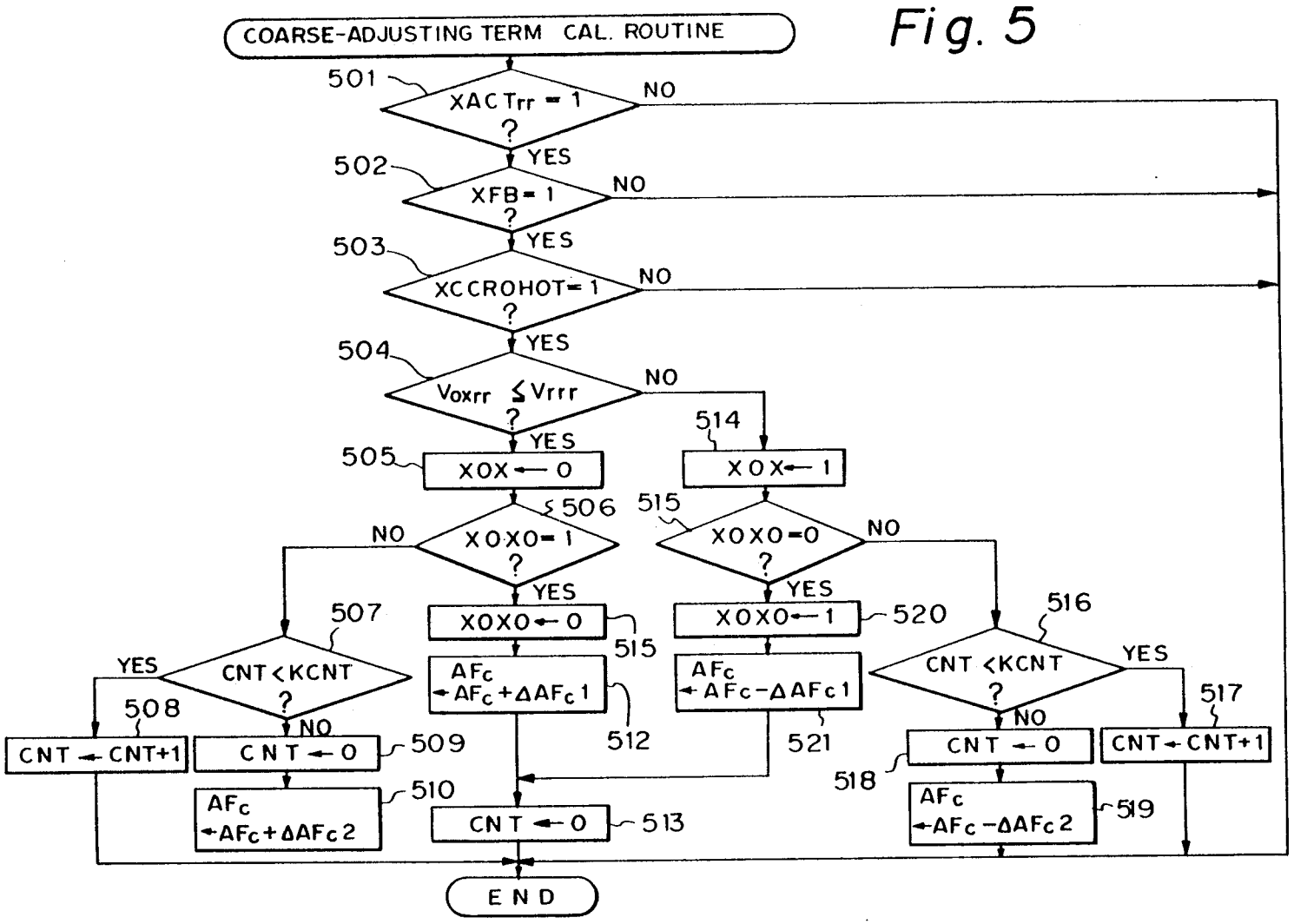

FIG. 5 is a routine for calculating a coarse-adjusting term AFc in accordance with the output voltage Voxrr of the downstream $O_2$ sensor 15, and is executed at predetermined intervals such as 4 ms.

In step 501, it is determined whether or not the flag XACTrr is "1". If XACTrr is "0", which means that the downstream $O_2$ sensor 15 has not been activated, this routine is completed.

When XACTrr is "1", which means that the downstream $O_2$ sensor 15 has been activated, the control proceeds to step 502 and it is determined whether or not XFB is "1".

If XFB is "0", which means that the air-fuel ratio feedback control conditions are satisfied, the control proceeds to step 503 and it is determined whether or not the flag XCCROHOT, which is set by a later-described routine, is "1".

If XCCROHOT is "0", which means that the catalyst converter is cold, this routine is completed.

If XCCROHOT is "1", which means that the warming-up of the catalyst converter has been completed, the control proceeds to step 504 and the output of the downstream $O_2$ sensor 15, Voxrr is compared with the predetermined reference Vrrr, e.g., 0.45 V. If Voxrr is smaller than Vrrr, which means that the current air-fuel ratio is lean, the control proceeds to step 505 and "0" is set in the air-fuel ratio flag XOX. Then, at step 506, it is determined whether or not a previous air-fuel ratio flag XOXO is "1" (rich), i.e., the air-fuel ratio flag XOX is reversed. If the previous air-fuel ratio XOXO is "0", which means that the rich state is still continuing, the control proceeds to step 507.

In step 507, it is determined whether or not the counter CNT, which determines the continuance of the rich or lean state, is smaller than the predetermined value KCNT. If CNT is smaller than KCNT, the control proceeds to step 508 and CNT is incremented, and this routine is then completed.

If CNT is equal to KCNT, the control proceeds to step 509, and "0" is set in the counter CNT. Then, at step 510, the coarse-adjusting term AFc is increased by $\Delta$AFc2, which means that the coarse-adjusting term is integrally increased at predetermined intervals (for example 4 ms) x KCNT, and this routine is then completed.

When XOXO is "1", which means that XOXO is reversed, the control proceeds to step 511 and "0" is set in XOXO. Then, at step 512, $\Delta$AFc1 is added to the coarse-adjusting term AFc, which means that the coarse-adjusting term is greatly increased when the air-fuel ratio is reversed from rich to lean. At step 513, the counter CNT is reset to "0", and this routine is then completed.

When the output voltage Voxrr of the downstream $O_2$ sensor 15 is larger than the reference Vrrr, the control proceeds to step 514, and "1" is set in the air-fuel ratio flag XOX. Then at step 515, it is determined whether or not the previous air-fuel ratio flag XOXO is "0".

If XOXO is "1", the control proceeds to step 516, and the counter CNT is compared with KCNT.

When CNT is smaller than KCNT, the control proceeds to step 517 and CNT is incremented and this routine is then completed.

If CNT is equal to KCNT, the control proceeds to step 518, and "0" is set in the CNT. Then, at step 519, ΔAFc2 is subtracted from the coarse-adjusting term and this routine is then completed.

If XOXO is "0", the control proceeds to step 520, and "1" is set in XOXO. Then, at step 521, ΔAFc1 is subtracted from the coarse-adjusting term AFc, and the control then proceeds to step 513.

As a result, if the actual air-fuel ratio approaches the stoichiometric ratio, the integral action does not function, and only the great action functions as the self-oscillating term because the counter is reset within the predetermined period KCNT at step 513.

When the air-fuel ratio is far from the stoichiometric ratio, it takes a long time to converge the air-fuel ratio to the stoichiometric ratio with only the coarse-adjusting term, and it is impossible to lower HC, CO and $NO_x$ emissions during this time.

To solve this problem, the air-fuel ratio is compensated with the $O_2$ storage term.

Figure 6:
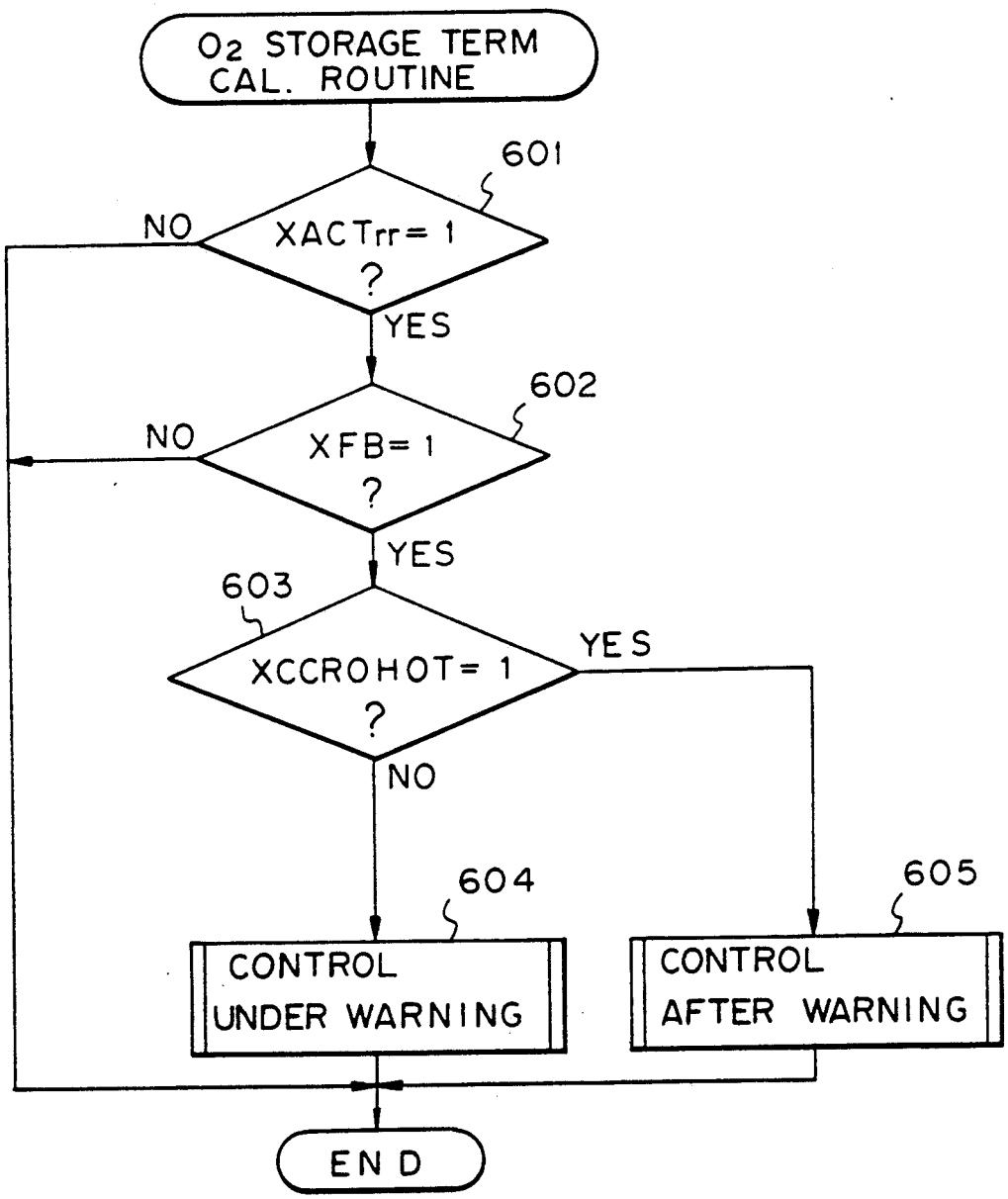

FIG. 6 is the routine for calculating the $O_2$ storage term executed at predetermined intervals such as 16 ms.

At step 601, it is determined whether or not the flag XACTrr is "1", which means that the downstream $O_2$ sensor 15 has been activated.

If XACTrr is "0", this routine is completed, but if XACTrr is "1", the control proceeds to step 602 and it is determined whether or not the air-fuel ratio feedback control conditions are satisfied. In FIG. 2, the downstream $O_2$ sensor 15 is activated at $t_6$.

At step 602, if the flag XFB is "0", which means that the feedback control conditions are not satisfied, this routine is completed.

When XFB is "1", the control proceeds to step 603 and it is determined whether or not the flag XCCROHOT is "1".

If the flag XCCROHOT is "0", which means that the catalyst converter 12 is being warmed-up, the control proceeds to step 604, which executes the routine for determining the $O_2$ storage term under a warming-up condition of the catalyst converter, as shown between $t_6$ and $t_9$ in FIG. 2.

When the flag XCCROHOT is "1", the control proceeds to step 605, which executes the routine for determining the $O_2$ storage term after the warming-up of the catalyst converter is completed as shown after $t_9$ in FIG. 2.

Note, the reason why the control mode is changed in accordance with whether or not the warming-up of the catalyst converter is completed, is as follows.

Figure 7:
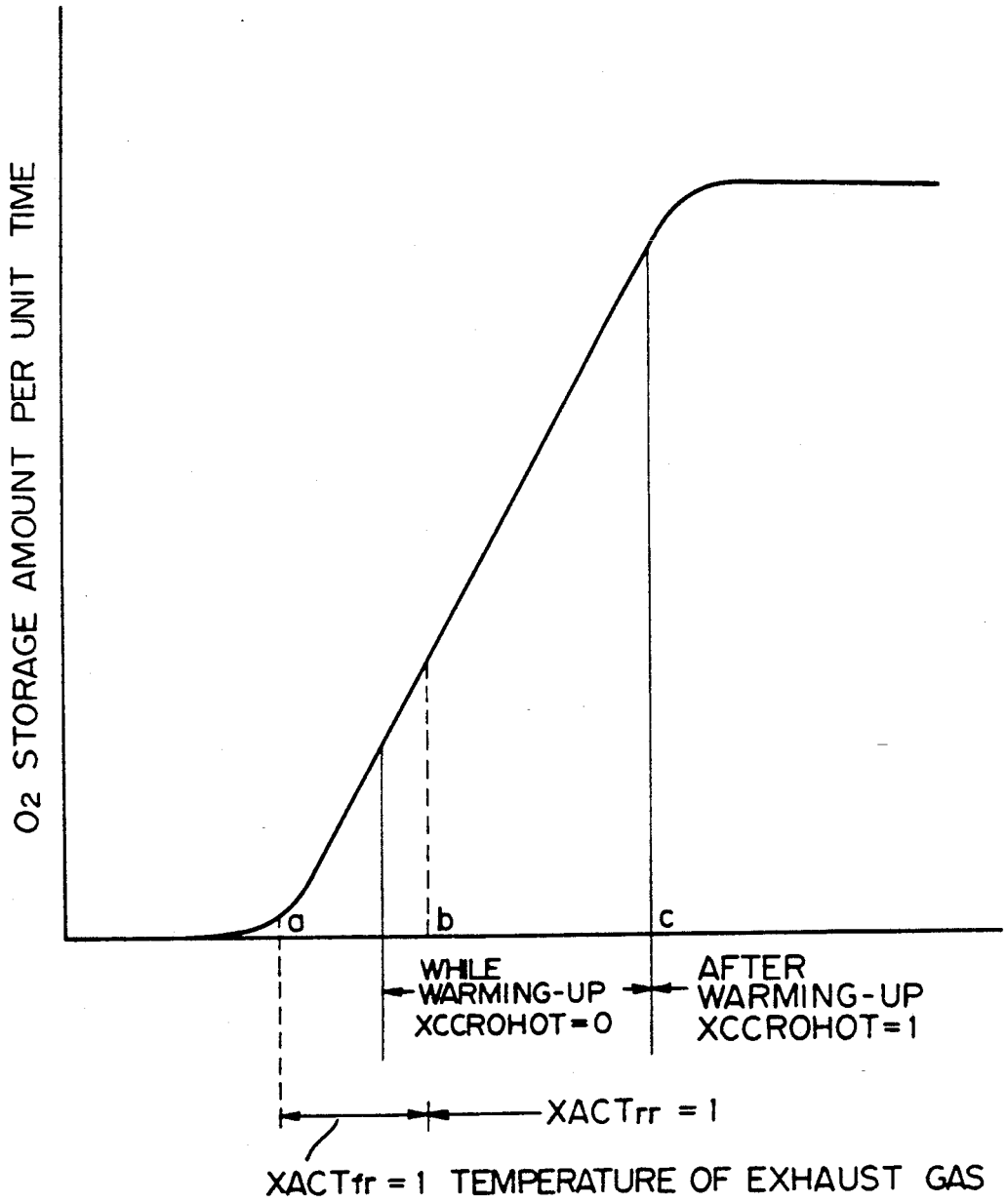
FIG. 7 is a graph showing the relationship between an exhaust gas temperature and an $O_2$ storage capacity per unit time, of the catalyst converter.

FIG. 7 is a graph showing the relationship between the temperature of the exhaust gas, which denotes the degree of the warming-up of the catalyst converter, and the absorption amount, per unit time, of oxygen in the catalyst converter, which denotes the $O_2$ storage effect of the catalyst converter.

Note, in FIG. 7, "a" shows that the upstream $O_2$ sensor 13 has been activated, "b" shows that the downstream $O_2$ sensor 15 has been activated, and "c" shows that the warming-up of the catalyst converter has been completed.

As understood from FIG. 7, after the completion of warning-up of the catalyst converter, the amplitude of the $O_2$ storage term can be made a large value, because the $O_2$ storage effect is high, but while the catalyst converter is in the warming-up state, the amplitude of the $O_2$ storage term cannot be made a large value because the $O_2$ storage effect is low. The changeover of the integral speed at the completion of the warming-up of the catalyst converter is required to ensure a rapid convergence of the air-fuel ratio to the stoichiometric state.

Figure 8:
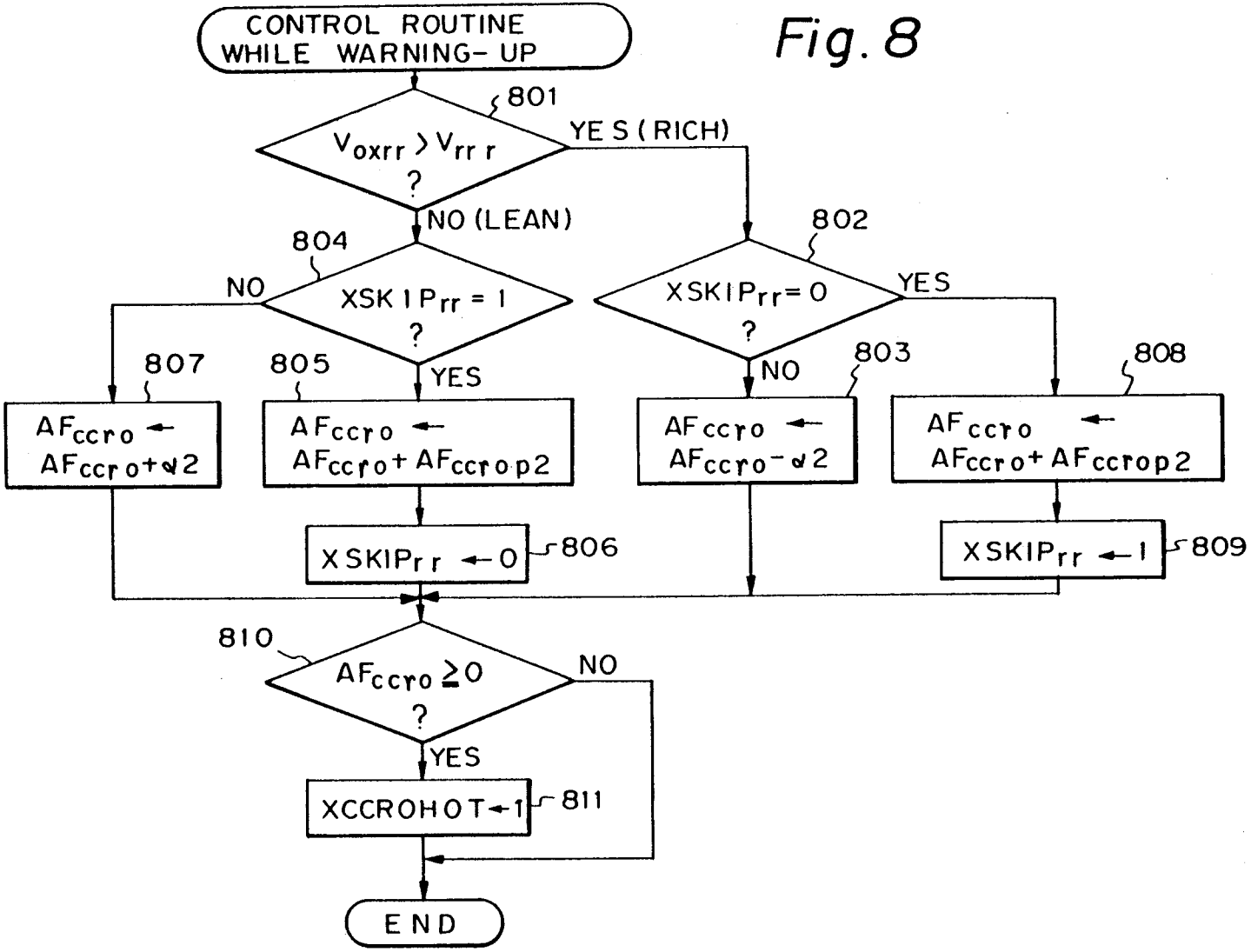

FIG. 8 is a routine for calculating the $O_2$ storage term when the catalyst converter is in a warming-up state, and is executed at predetermined intervals such as 16 ms.

At step 801, it is determined whether or not the output voltage Vxorr of the downstream $O_2$ sensor 15 is larger than the reference Vrrr.

If Voxrr is larger than Vrrr, which means that the current air-fuel ratio is rich, the control proceeds to step 802 and it is determined whether or not the flag XSKIPrr is "0".

When XSKIPrr is "1", which means that the rich state has continued since the previous execution, the control proceeds to step 803, which reduces the $O_2$ storage term AFccro by $\alpha 2$. Therefore, the $O_2$ storage term AFccro is integrally lowered at each execution of step 803, as shown from $t_6$ to $t_7$ in FIG. 1. The control then proceeds to step 810.

When the current air-fuel ratio becomes lean as the result of the lowering of the $O_2$ storage term AFccro, the control proceeds to step 804 and it is determined whether or not the flag XSKPIPrr is "1".

If XSKIPrr is "1", which means that the air-fuel ratio has been changed from rich to lean, the control proceeds to step 805, and the $O_2$ storage term AFccro is greatly increased by AFccro2. Then, at step 806 the flag XSKIPrr is reset to "0", and the control then proceeds to step 810.

When the lean state continues thereafter, the control proceeds to step 807, at which $\alpha 2$ is added to the $O_2$ storage term AFccro, and then proceeds to step 810, and therefore, the $O_2$ storage term AFccro is integrally increased, as shown from $t_7$ and $t_8$ in FIG. 2.

If the current air-fuel ratio is become rich as the result of the increase of the $O_2$ storage term AFccro, the control proceeds to step 808, and the $O_2$ storage term AFccro is greatly lowered by AFccrop2. Then, at step 809, the flag XSKIPrr is set to "1", and the control proceeds to 810.

When the rich state continues thereafter, the control proceeds to step 803 and the $O_2$ storage term AFccro is integrally lowered.

At step 810, it is determined whether or not the $O_2$ storage term AFccro is positive.

If the $O_2$ storage term AFccro is negative, which means that the catalyst converter is in a warming-up state, this routine is executed continuously.

After the $O_2$ storage term AFccro becomes positive, the control proceeds to step 811, and "1" is set in the flag XCCROHOT. Note, when "1" is set in XCCRO- HOT, the warming-up process of the catalyst converter has been completed.

After XCCROHOT becomes "1", i.e., after $t_9$ in FIG. 2, the routine for determining the $O_2$ storage term AFccro after the warming-up is executed.

Figure 9:
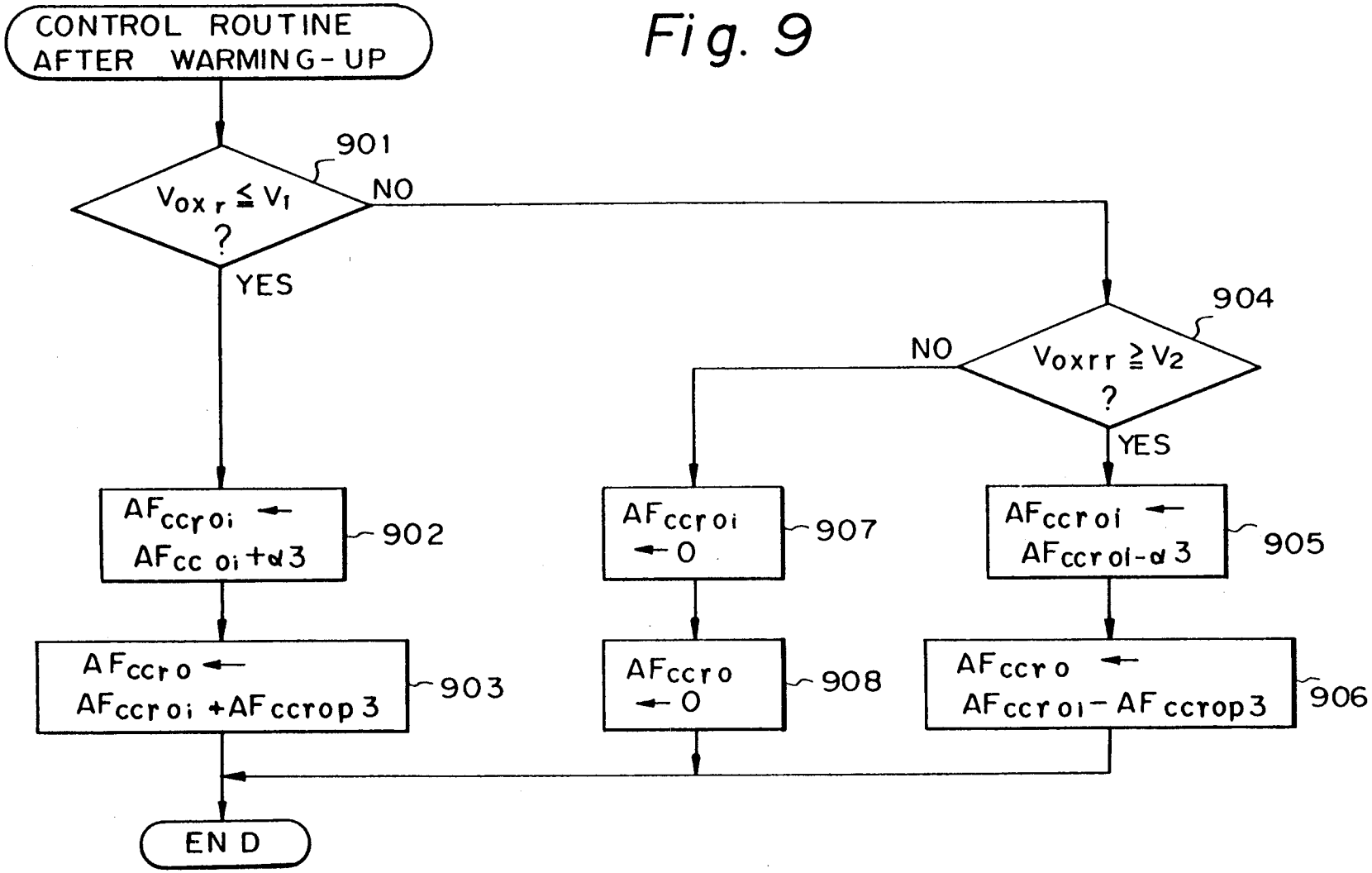

FIG. 9 shows the routine for calculating the $O_2$ storage term AFccro after the warming-up, and is executed at predetermined intervals such as 16 ms.

At step 901, it is determined whether or not the output voltage Voxrr of the downstream $O_2$ sensor 15 is smaller than the first threshold value $V_1$. If Voxrr is larger than $V_1$, at step 904 it is determined whether or not Voxrr is larger than the second threshold value $V_2$. Note, a range of the output Voxrr of the downstream $O_2$ sensor 15 is divided into three regions, as follows:

"L" (lean) region: 0.0(Volt)~$V_1$

"S" (stoichiometric) region: $V_1 \sim V_2$

"R" (rich) region: $V_2$~1.0(Volt)

As a result, when Voxrr is smaller than $V_1$, which means that the current air-fuel ratio is in the "L" region, the control proceeds to step 902 and an integral $O_2$ storage amount AFccroi is gradually increased by $$AFccroi \rightarrow AFccroi + \alpha 3 \text{ (definite)}$$

Then, at step 903, the $O_2$ storage term AFccro is calculated by $$AFccro \rightarrow AFccroi + AFccrop3$$

Therefore, the $O_2$ storage term AFccro is first incremented by AFccrop3, then integrally increased with the integral speed $\alpha 3$, as shown from $t_{10}$ to $t_{11}$ in FIG. 2.

When Voxrr is higher than the first threshold value $V_1$, as the result of the increase of the $O_2$ storage term AFccro, the control proceeds to step 904 and it is determined whether or not Voxrr is larger than the second threshold value $V_2$.

If Voxrr is smaller than $V_2$, which means that the current air-fuel ratio is in the "S" region, the control proceeds to step 907, and "0" is set in AFccroi, and to step 908 where "0" is set in AFccro.

Therefore, the $O_2$ storage term AFccro is reset to "0", as shown from $t_{11}$ to $t_{12}$ in FIG. 2.

If the current air-fuel ratio becomes higher than the second threshold value $V_2$, the control proceeds to step 905 and an integral $O_2$ storage amount AFccroi is gradually decreased by $$AFccroi \rightarrow AFccroi - \alpha 3 \text{ (definite)}$$

Then, at step 906, the $O_2$ storage term AFccro is calculated by $$AFccro \rightarrow AFccroi - AFccrop3$$

Therefore, the $O_2$ storage term AFccro is first stepped down by AFccrop3, then integrally lowered with the integral speed $\alpha 3$, as shown from $t_{12}$ to $t_{13}$ in FIG. 2.

If the current air-fuel ratio becomes lean as the result of the lowering of the $O_2$ storage term AFccro, it is again reset to "0".

Note, the following relationship is satisfied among the integral speed $\alpha 1$ of the cold-condition compensating term, the integral speed $\alpha 2$, and the integral speed $\alpha 3$.

$$\alpha 1 > \alpha 3 > \alpha 2$$

As mentioned above, the response and the convergence are improved by the change-over of the integral speed in accordance with the warming-up state of the catalyst converter. Note, in the cold condition, although a fast response is required, a fine convergence is not necessary.

The following relationship is also satisfied among AFfr, the skip amount of the cold-condition compensating term, AFccrop2, the skip amount of the $O_2$ storage term, and the AFccrop3.

$$AFccrop3 > AFfr > AFccrop2$$

That is, the skip amount must be reduced, to improve the drivability.

Figure 10:
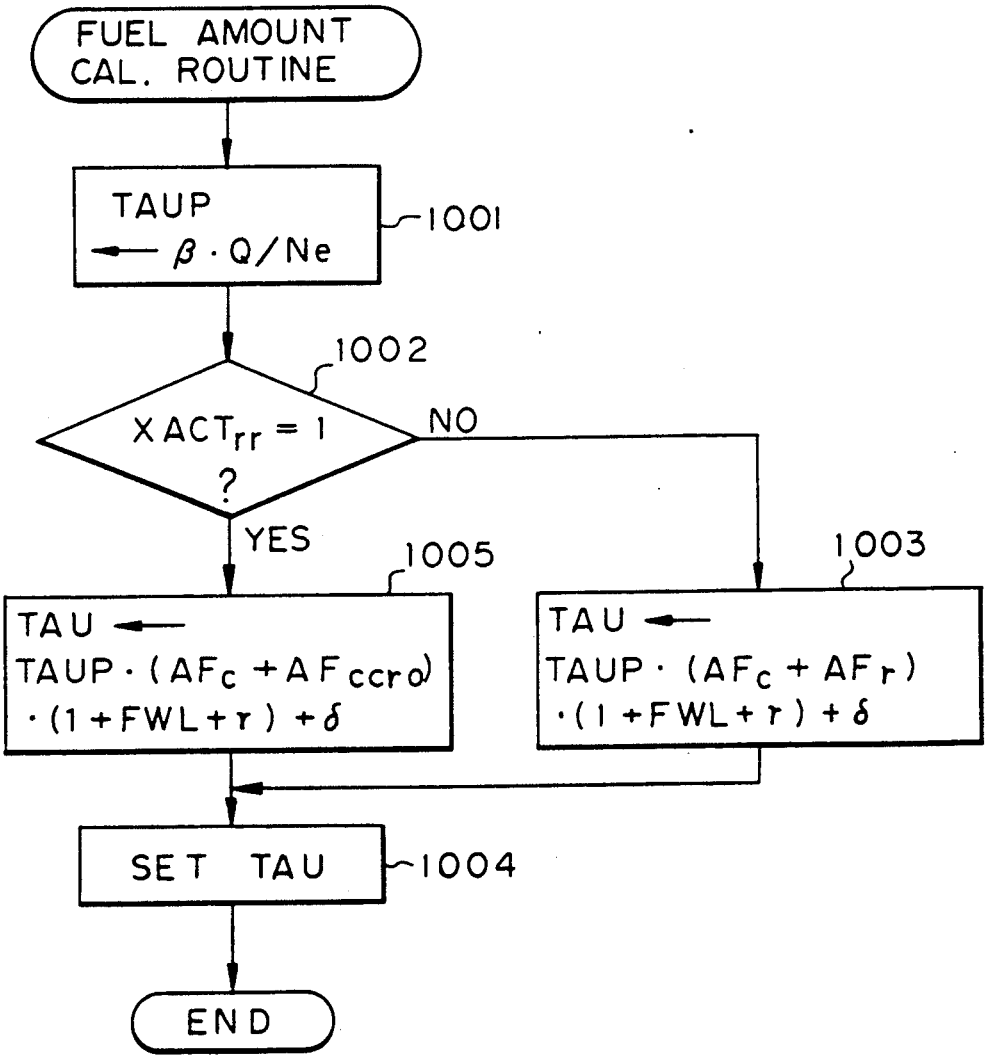

FIG. 10 shows a routine for calculating the fuel injection amount. At step 1001, the basic fuel injection amount TAUP is calculated based on the intake air-flow Q measured by the air-flow meter 3 and the engine rotating speed Ne determined by the output of the crank angle sensors 5 and 6, using the following equation.

$$TAUP = \beta \times Q/Ne \quad (1)$$

Where $\beta$ is constant.

At step 1002, it is determined whether or not the flag XACTrr is "1". If XACTrr is "0", which means that the downstream $O_2$ sensor 15 has not been activated, the control proceeds to step 1003, and the fuel injection amount is calculated using the following equation.

$$TAU = TAUP \times (AFrr + Afc) \times (1 + FWL + \gamma) + \delta \quad (2)$$

Where

AFc = the coarse-adjusting term

AFrr = the cold-condition compensating term

FWL = the fuel increasing factor during warming-up $\gamma$, $\delta$ = constant Note, the coarse-adjusting term is not renewed, and the value memorized at the previous running is used.

At step 1004, the fuel injection amount TAU is set to the counter 108, and the determined amount of fuel is then injected by the injector 7.

If the flag XACTrr is "1", which means that the downstream $O_2$ sensor 15 has been activated, the control proceeds to step 1005, and the fuel injection amount is calculated using the following equation.

$$TAU = TAUP \times (AFc + AFccro) \times (1 + FWL + \gamma) + \delta \quad (3)$$

Where AFccro = the $O_2$ storage term

Note, it is possible to add the self-oscillating-term AFs to the above equation (2) or (3), for a more positive use of the $O_2$ storage effect of the catalyst converter, as already suggested by the present inventor (see Japanese Unexamined Patent Publication (Kokai) No. 1-66441 published on Mar. 31, 1989).

Figure 11:
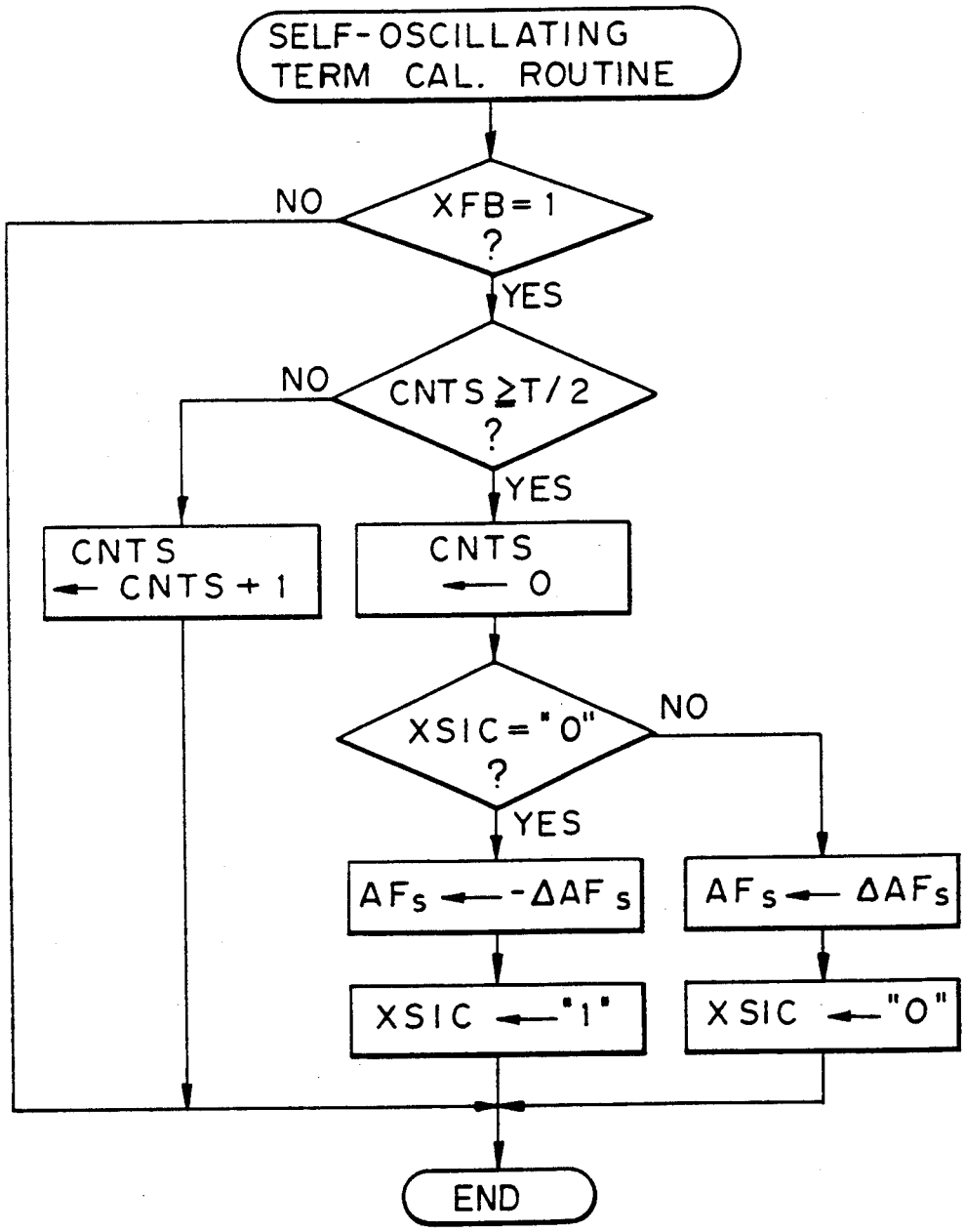
Figure 12:
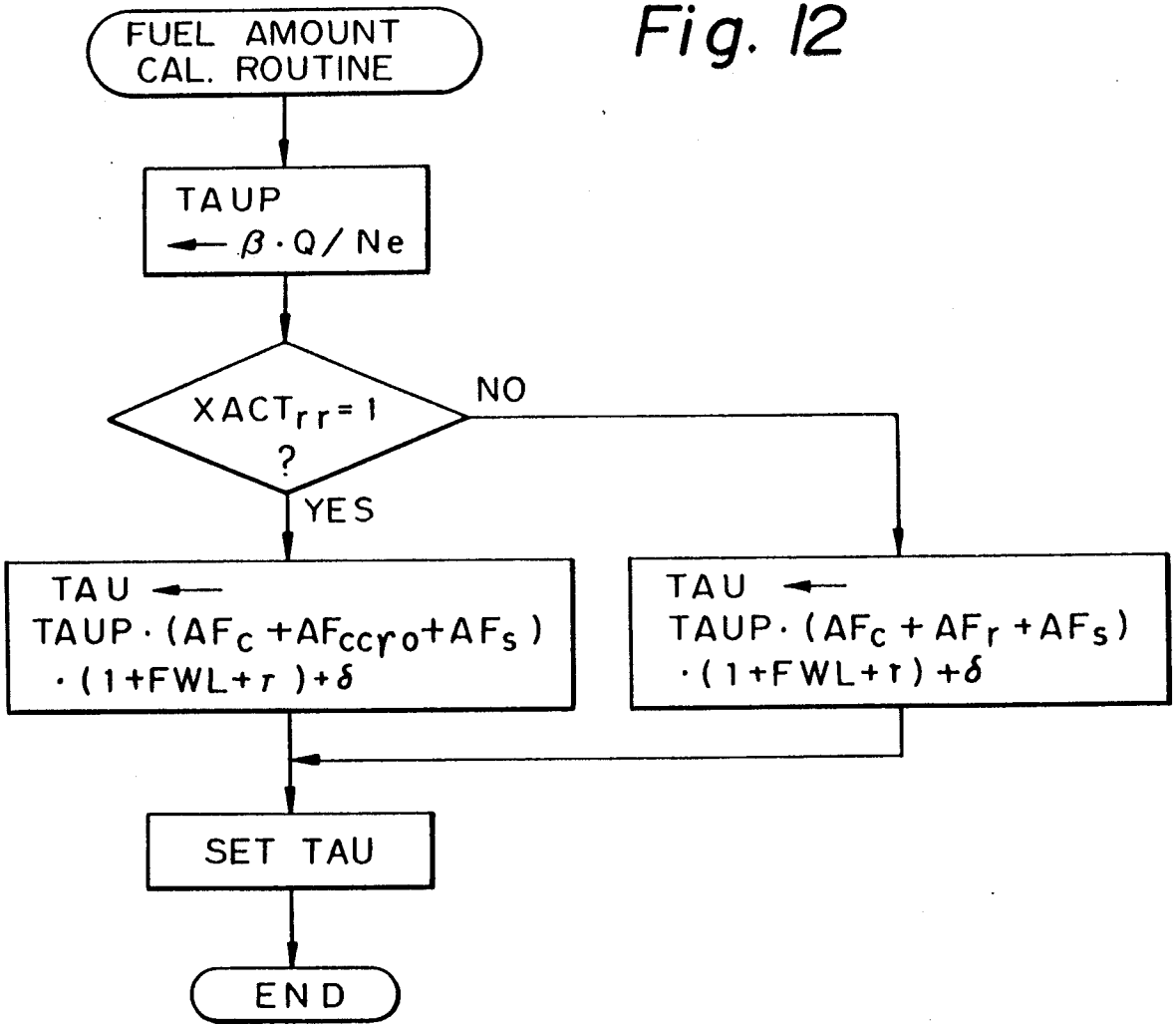

FIG. 11 shows the routine for calculating the self-oscillating term AFs, and FIG. 12 shows the routine for calculating the fuel injection amount TAU in this case.

Note, the present inventors have also suggested that the amplitude and period of the self-oscillating term can be changed according to the degree of warming-up of the catalyst converter, to improve the driveability (see U.S. Pat. No. 487,454 filed on Mar. 1, 1990 or Japanese Unexamined Patent Publication (Kokai) No. 2-230934 published on Sept. 13, 1990).

Although in the above-mentioned embodiments, the completion of the warming-up of the catalyst converter is determined from the value of the $O_2$ storage term, it also can be determined from engine parameters, such as the accumulated engine load or the coolant temperature measured by the temperature sensor 9.

We claim:

1. A method of controlling an air-fuel ratio in an internal combustion engine having a three-way catalyst converter for removing pollutants in the exhaust gas of said engine, a first air-fuel ratio sensor, disposed upstream of said three-way catalyst converter, for detecting a specific component in the exhaust gas, and a second air-fuel ratio sensor, disposed downstream of said three-way catalyst converter, for detecting a specific component in the exhaust gas, comprising the steps of:

determining whether or not said first air-fuel ratio sensor is active;

determining whether or not said second air-fuel ratio sensor is active;

gradually changing a cold-condition compensating term in accordance with the output of said first air-fuel ratio sensor when it is active;

gradually changing a coarse-adjusting term in accordance with the output of said second air-fuel ratio sensor when it is active;

gradually changing an $O_2$ storage adjusting term corresponding to an $O_2$ storage amount in said three-way catalyst converter in accordance with the output of said second air-fuel ratio sensor when it is active;

adjusting an actual air-fuel ratio in accordance with said coarse-adjusting term and said $O_2$ storage term when said second air-fuel-ratio sensor is active;

adjusting said actual air-fuel ratio in accordance with said cold-condition compensating term when said first air-fuel ratio sensor is active, and said second air-fuel ratio sensor is not active.

2. A method as set forth claim 1, further comprising the steps of:

determining whether or not the output of said second air-fuel ratio sensor is changed from a rich side to a lean side;

greatly increasing said coarse-adjusting term when the output of said second air-fuel ratio sensor is changed from the rich side to the lean side;

determining whether or not the output of said second air-fuel ratio sensor is changed from the lean side to the rich side;

greatly reducing said coarse-adjusting term when the output of said second air-fuel ratio sensor is changed from the lean side to the rich side.

3. A method as set forth claim 1, further comprising the steps of:

determining whether or not the output of said second air-fuel ratio sensor is changed from a rich side to a lean side;

greatly increasing said $O_2$ storage adjusting term when the output of said second air-fuel ratio sensor is changed from the rich side to the lean side;

determining whether or not the output of said second air-fuel ratio sensor is changed from the lean side to the rich side;

greatly reducing said $O_2$ storage adjusting term when the output of said second air-fuel ratio sensor is changed from the lean side to the rich side.

4. A method as set forth claim 1, further comprising the steps of:

determining whether or not the output of said first air-fuel ratio sensor is changed from the rich side to the lean side;

greatly increasing said cold-condition compensating term when the output of said first air-fuel ratio sensor is changed from the rich side to the lean side;

determining whether or not the output of said first air-fuel ratio sensor is changed from the lean side to the rich side;

greatly reducing said cold-condition compensating term when the output of said first air-fuel ratio sensor is changed form the lean side to the rich side.

5. A method as set forth claim 1, further comprising the steps of:

determining whether or not the warming-up of said catalyst converter is completed;

increasing said gradual change of a speed of said $O_2$ storage adjusting term when the warming-up of said catalyst converter is completed.

6. A method as set forth claim 3, further comprising the steps of:

determining whether or not the warming up of said catalyst converter is completed;

increasing the great change of an amount of said $O_2$ storage adjusting term when the warming up of said catalyst converter is completed.

7. A method as set forth claim 5, further comprising the steps of:

determining whether or not the output of said second air-fuel ratio sensor is in a semi-stoichiometric air-fuel ratio region between a first threshold value which is smaller than a value corresponding to the stoichiometric air-fuel ratio and a second threshold value which is larger than a value corresponding to the stoichiometric air-fuel ratio;

eliminating said $O_2$ storage adjusting term when the output of said second air-fuel ratio sensor is in said semi-stoichiometric air-fuel ratio region.

8. A method as set forth claim 5, wherein said gradually changing speeds satisfy a following relationship;

$$\alpha 1 > \alpha 3 > \alpha 2$$

where $\alpha 1$ = gradual change of a speed of said cold-condition compensating term $\alpha 2$ = gradual change of speed of said $O_2$ storage adjusting term when the warming-up of said catalyst converter is not completed.

$\alpha 3$ = gradual change of a speed of said $O_2$ storage adjusting term when the warming-up of said catalyst converter is completed.

9. A method as set forth claim 3, further comprising the steps of:

determining whether or not output of said first air-fuel ratio sensor is changed from the rich side to the lean side;

greatly increasing said cold-condition compensating term when the output of said first air-fuel ratio sensor is changed from the rich side to the lean side;

determining whether or not the output of said first air-fuel ratio sensor is changed from the lean side to the rich side;

greatly reducing said cold-condition compensating term when the output of said first air-fuel ratio sensor is changed from the rich side to the lean side;

determining whether or not the output of said second air-fuel ratio sensor is changed from the rich side to the lean side;

greatly increasing said $O_2$ storage adjusting term when the output of said second air-fuel ratio sensor is changed from the rich side to the lean side;

determining whether or not the output of said second air-fuel ratio sensor is changed from the rich side to the lean side;

greatly reducing said $O_2$ storage adjusting term when the output of said second air-fuel ratio sensor is changed from the rich side to the lean side;

wherein said greatly changed values satisfy a following relationship;

$$AFccrop3 > AFfrp > AFccrop2$$

where

AFfr = great change of a value of said cold-condition compensating term

AFccrop2 = great change of a value of said $O_2$ storage adjusting term when the warming-up of said catalyst converter is not completed.

AFccrop3 = great change of a value of said $O_2$ storage adjusting term when the warming-up of said catalyst converter is completed.

10. A method as set forth claim 1, further comprising a step of generating a self-oscillating term having a predetermined amplitude and a predetermined period, to thereby adjust said actual air-fuel ratio in accordance with said self-oscillating term.

11. A method as set forth claim 10, further comprising the steps of:

determining whether or not said engine is in an idling sate;

lowering said predetermined amplitude of said self-oscillating term when said engine is in said idling state;

increasing said predetermined period of said self-oscillating term when said engine is in said idling state.

12. A method as set forth claim 5, wherein said step of determining whether or not the warming-up of said catalyst converter is completed comprises a step of first determining whether or not said $O_2$ storage adjusting term has reached "0".

13. An apparatus of controlling an air-fuel ratio in an internal combustion engine having a three-way catalyst converter for removing pollutants in the exhaust gas of said engine, a first air-fuel ratio sensor, disposed upstream of said three-way catalyst converter, for detecting a specific component in the exhaust gas, and a second air-fuel ratio sensor, disposed downstream of said three-way catalyst converter, for detecting a specific component in the exhaust gas, comprising:

means for determining whether or not said first air-fuel ratio sensor is active;

means for determining whether or not said second air-fuel ratio sensor is active;

means for gradually changing a cold-condition compensating term in accordance with the output of said first air-fuel ratio sensor when it is active;

means for gradually changing a coarse-adjusting term in accordance with the output of said second air-fuel ratio sensor when it is active;

means for gradually changing an $O_2$ storage adjusting term corresponding to an $O_2$ storage amount in said three-way catalyst converter in accordance with the output of said second air-fuel ratio sensor when it is active;

means for adjusting an actual air-fuel ratio in accordance with said coarse-adjusting term and said $O_2$ storage term when said second air-fuel ratio sensor is active;

means for adjusting said actual air-fuel ratio in accordance with said cold-condition compensating term when said first air-fuel ratio sensor is active, and said second air-fuel ratio sensor is not active.

14. An apparatus as set forth claim 13, further comprising:

means for determining whether or not the output of said second air-fuel ratio sensor is changed from the rich side to the lean side;

means for greatly increasing said coarse-adjusting term when the output of said second air-fuel ratio sensor is changed from the rich side to the lean side;

means for determining whether or not the output of said second air-fuel ratio sensor is changed from the lean side to the rich side;

means for greatly reducing said coarse-adjusting term when the output of said second air-fuel ratio sensor is changed from he lean side to the rich side.

15. An apparatus as set forth claim 13, further comprising:

means for determining whether or not the output of said second air-fuel ratio sensor is changed from the rich side to the lean side;

means for greatly increasing said $O_2$ storage adjusting term when the output of said second air-fuel ratio sensor is changed from the rich side to the lean side;

means for determining whether or not the output of said second air-fuel ratio sensor is changed from the lean side to the rich side;

means for greatly reducing said $O_2$ storage adjusting term when the output of said second air-fuel ratio sensor is changed from the lean side to the rich side.

16. An apparatus as set forth claim 13, further comprising:

means for determining whether or not the output of said first air-fuel ratio sensor is changed from the rich side to the lean side;

means for greatly increasing said cold-condition compensating term when the output of said first air-fuel ratio sensor is changed from the rich side to the lean side;

means for determining whether or not the output of said first air-fuel ratio sensor is changed from the lean side to the rich side;

means for greatly reducing said cold-condition compensating term when the output of said first air-fuel ratio sensor is changed from the lean side to the rich side.

17. An apparatus as set forth claim 13, further comprising:

means for determining whether or not the warming-up of said catalyst converter is completed;

means for increasing said gradual change of a speed of said $O_2$ storage adjusting term when the warming-up of said catalyst converter is completed.

18. An apparatus as set forth claim 15, further comprising:

means for determining whether or not the warming-up of said catalyst converter is completed;

means for increasing the great change in an amount of said $O_2$ storage adjusting term when the warming-up of said catalyst converter is completed.

19. An apparatus as set forth claim 17, further comprising:

means for determining whether or not the output of said second air-fuel ratio sensor is in a semi-stoichiometric air-fuel ratio region between a first threshold value which is smaller than a value corresponding to the stoichiometric air-fuel ratio and a second threshold value which is larger than a value corresponding to the stoichiometric air-fuel ratio;

means for eliminating said $O_2$ storage adjusting term when the output of said second air-fuel ratio sensor is in said semi-stoichiometric air-fuel ratio region.

20. An apparatus as set forth claim 17, wherein said gradually changing speeds satisfy a following relationship;

$$\alpha 1 > \alpha 3 > \alpha 2$$

where $\alpha 1$ = gradual change of a speed of said cold-condition compensating term $\alpha 2$ = gradual change of a speed of said $O_2$ storage adjusting term when the warming-up of said catalyst converter is not completed.

$\alpha 3$ = gradual change of a speed of said $O_2$ storage adjusting term when the warming-up of said catalyst converter is completed.

21. An apparatus as set forth claim 13, further comprising:

means for determining whether or not the output of said first air-fuel ratio sensor is changed from the rich side to the lean side;

means for greatly increasing said cold-condition compensating term when the output of said first air-fuel ratio sensor is changed from the rich side to the lean side;

means for determining whether or not the output of said first air-fuel ratio sensor is changed from the lean side to the rich side;

means for greatly reducing said cold-condition compensating term when the output of said first air-fuel ratio sensor is changed from the rich side to the lean side;

means for determining whether or not the output of said second air-fuel ratio sensor is changed from the rich side to the lean side;

means for greatly increasing said $O_2$ storage adjusting term when the output of said second air-fuel ratio sensor is changed from the rich side to the lean side;

means for determining whether or not the output of said second air-fuel ratio sensor is changed from the rich side to the lean side;

means for greatly reducing said $O_2$ storage adjusting term when the output of said second air-fuel ratio sensor is changed from the rich side to the lean side;

wherein said greatly changed value satisfy following relationship;

$$AFccrop3 > AFfrp > AFccrop2$$

where

Affr = great change of a value of said cold-condition compensating term

AFccrop2 = great change of a value of said $O_2$ storage adjusting term when the warming-up of said catalyst converter is not completed.

AFccrop3 = great change of a value of said $O_2$ storage adjusting term when the warming-up of said catalyst converter is completed.

22. An apparatus as set forth claim 13, further comprising means for generating a self-oscillating term having a predetermined amplitude and a predetermined period, to thereby adjust said actual air-fuel ratio in accordance with said self-oscillating term.

23. An apparatus as set forth claim 22, further comprising:

means for determining whether or not said engine is in an idling state;

means for lowering said predetermined amplitude of said self-oscillating term when said engine is in said idling state;

means for increasing said predetermined period of said self-oscillating term when said engine is in said idling state.

24. An apparatus as set forth claim 17, wherein said means of determining whether or not the warming-up of said catalyst converter is completed comprises means for first determining whether or not said $O_2$ storage adjusting term has reached "0".

* * * * *

UNITED STATES PATENT AND TRADEMARK OFFICE

CERTIFICATE OF CORRECTION

PATENT NO. : 5,092,123

DATED : March 3, 1992

INVENTOR(S) : Nada et al.

It is certified that error appears in the above-identified patent and that said Letters Patent is hereby corrected as shown below:

Column 9, line 17, change "0.0(Volt)" to --0.0 (Volt)--.
line 21, change "1.0(Volt)" to --1.0. (Volt)--.
lines 28, 33, 55 and 60, change "AFccroi→" to --AFccroi←--.

Signed and Sealed this

Twenty-first Day of June, 1994

*Attest:*

*Attesting Officer*

BRUCE LEHMAN

*Commissioner of Patents and Trademarks*